United States Patent [19]

James

[11] Patent Number: 4,978,166

[45] Date of Patent: Dec. 18, 1990

[54] SUNSHADE FOR CHILD CAR SEATS

[76] Inventor: Francis C. James, 304 Harker Rd., Fort Oglethorpe, Ga. 30742

[21] Appl. No.: 460,420

[22] Filed: Jan. 3, 1990

[51] Int. Cl.[5] ..... A47C 7/62

[52] U.S. Cl. ..... 297/184; 297/400

[58] Field of Search ..... 297/184, 400, 414; 5/416, 418; 135/96, 97

[56] References Cited

U.S. PATENT DOCUMENTS

| | | | |
|---|---|---|---|
| 1,039,993 | 10/1912 | Murphy | 5/416 |
| 2,551,701 | 5/1951 | Prentice | 297/184 |
| 2,667,913 | 2/1954 | Dustin | 297/414 X |
| 2,932,833 | 4/1960 | Wambach | 5/418 X |
| 4,063,318 | 12/1977 | Nicholson | 297/184 X |
| 4,093,305 | 6/1978 | Staroste et al. | 297/184 |

*Primary Examiner*—Jose V. Chen

*Attorney, Agent, or Firm*—Alan Ruderman

[57] ABSTRACT

A sunshade assembly for use with a child or infant safety car seat has a canopy mounted on a plurality of ribs pivotably carried at respective ends of a base portion on which the car seat may be positioned. The base portion is formed from a pair of transversely extending brackets adjustably connected together so that the base may be expanded or contracted to receive car seats of varying widths. A transversely elongated slot in one of the brackets permits the brackets to be adjustably connected together. The ribs are formed from tubular members which securely receive and grip tangs in the ends thereof, the tangs being formed integral with disks which overlay each other at the respective ends of the brackets and are pivotably connected to upstanding walls at the exterior ends of the brackets.

14 Claims, 1 Drawing Sheet

SUNSHADE FOR CHILD CAR SEATS

BACKGROUND OF THE INVENTION

This invention relates to a sunshade for child car seats and more particularly to a universal sunshade that is adjustable for utilization with child or infant safety car seats of various sizes.

Child or infant car seats that are secured on a passenger seat of an automobile by means of the seat belt of the automobile are well known restraining devices, and some form of approved child car seat is required to be utilized in many, if not, all of the states. Such car seats include safety belts for securely locking the child into the car seat, and the securement of the car seat to the automobile passenger seat provides a safety restraint in the event of an accident. However, when positioned within such restraining devices in the vehicle on a sunny day, a child is generally unprotected by the rays of the sun which enter into the passenger compartment. When traveling on a relatively long trip this not only can present an annoyance making the child cranky but can also present a hazard to the child, especially an infant, due to excessive exposure of the sun's rays. Not only is an infant's skin sensitive to the rays, but great harm can be presented to its eyes.

It is known that one manufacturer offers infant car seats constructed with a permanently attached sun shading canopy. Since the shade cannot be removed from the seat, it presents an inconvenience when, as is customary, the seat is removed from the car and used indoors. Additionally, if one desires another car seat having a different construction or size, as when an infant outgrows the infant seat but still requires a child car seat, a shade is not available.

SUMMARY OF THE INVENTION

Consequently, it is a primary object of the present invention to provide a sunshade for use with infant or child car seats which is separate from the car seat and which can be utilized with a multitude of such seats.

It is another object of the present invention to provide a sunshade for use with an infant or child car seat, the shade having an adjustable base on which car seats of various sizes may be positioned for securement in the car while straddled by the canopy of the sunshade.

Accordingly, the present invention provides a sunshade having a plurality of canopy carrying struts or ribs pivotably mounted on and extending from opposite transverse ends of a base, the base comprising a pair of members adjustably connected together so as to be movable transversely relative to each other. The base may therefore be adjusted so as to receive and may be used with infant or child car seats of varying widths. The seat is positioned on the base with the struts or ribs bridging the car seat which is secured conventionally by the seat belts of the car and the canopy can be extended over the infant or child or retracted or folded behind the car seat by pivotable movement of the struts.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
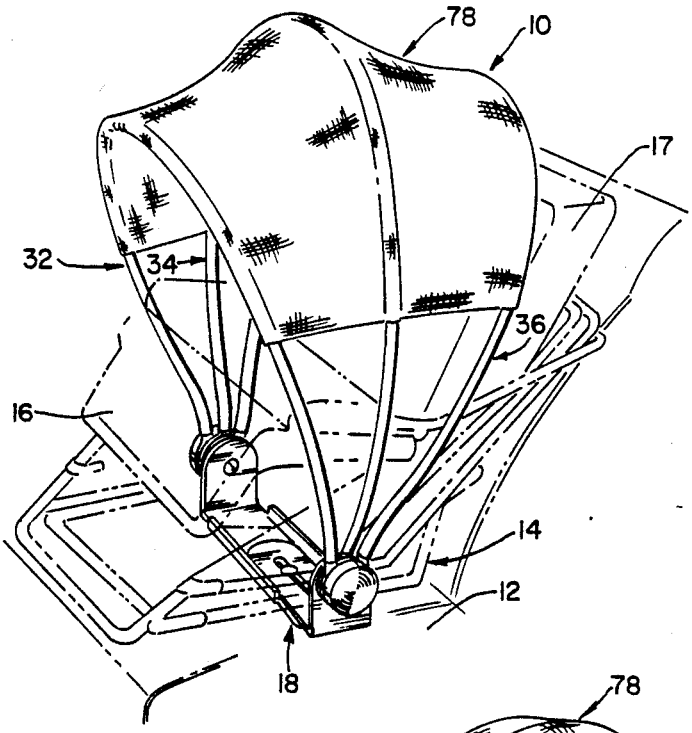
FIG. 1 is a perspective view of a sunshade constructed in accordance with the principles of the present invention illustrating the shade in an operative disposition on an infant or child car seat and with the canopy in the open position.
Figure 2:
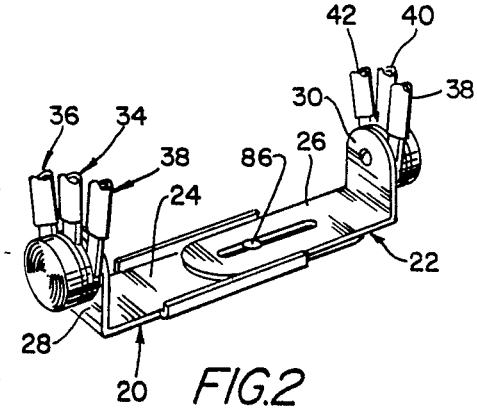
FIG. 2 is a fragmentary perspective view of the lower portion of the sunshade illustrated in FIG. 1.
Figure 3:
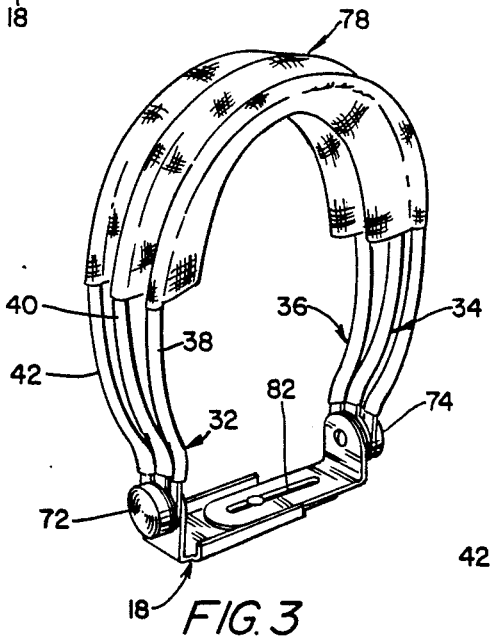
FIG. 3 is a perspective view of the sunshade illustrating the canopy in a closed position.
Figure 4:
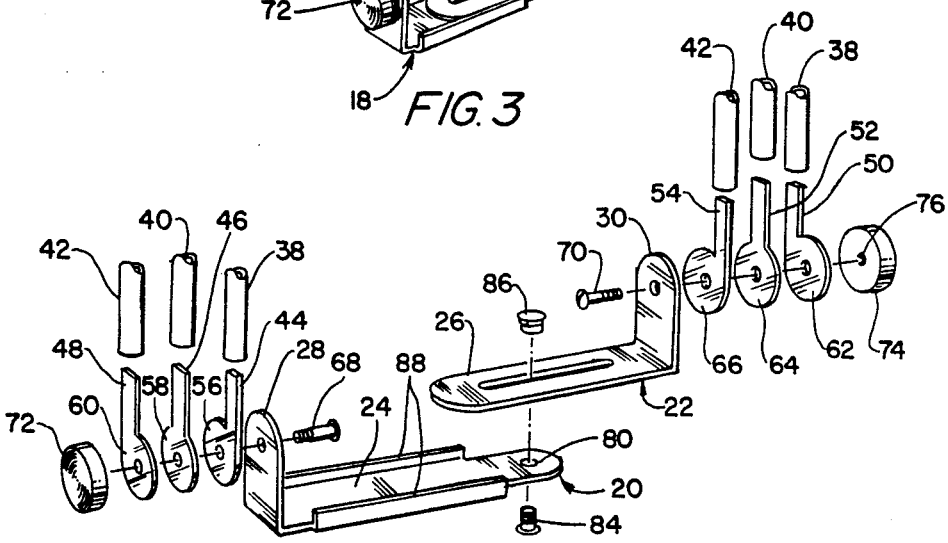
FIG. 4 is a dissassembled perspective view of the portion of the sunshade illustrated in FIG. 2.

Referring now to the drawings, FIG. 1 illustrates a sunshade assembly generally illustrated at 10 in an operative disposition on the seat 12 of a vehicle for use in conjunction with a car seat 14 for infants, toddlers or small children, the car seat being conventional and having a seat portion 16 and a back rest 17. The car seat 10 is disposed on a base portion of the sunshade assembly generally indicated at 18 and is securely and conventionally held in place by the seat belts of the vehicle passing through openings or other cooperative attachment means for this purpose in the car seat.

The base portion of the sunshade assembly comprises a pair of L-shape brackets 20, 22 having respective elongated bottom leg members 24, 26 which are interconnected together as hereinafter described, and respective upstanding legs 28,30. Each upstanding leg pivotably supports respective ends of a plurality of substantially U-shaped struts or ribs, there being three such ribs 32,34 and 36 in the preferred embodiment, but the number of such ribs is not critical and may be varied as desired. Preferably each rib 32, 34, 36 has a main portion comprising a respective resilient tubular member 38, 40, 42 formed from a synthetic plastic material, such as flexible polyvinylchloride, and bent or formed into the arcuate U-shaped form. The hollows at each end of each tubular member receive and securely hold a respective tang 44, 46, 48 and 50, 52, 54 formed integral with and extending substantially radially as in the case of the tangs 46 and 52, or tangentially, in regard to the others, from a respective journal plate in the form of a disk 56, 58, 60 and 62, 64, 66.

The disks at each transverse end have respective bores aligned axially for receiving a respective journal pin 68 and 70 which extends respectively through the upstanding legs 28, 30 of the base portion 18. In the preferred embodiment the journal pins may be shoulder screws extending such that their heads abut the internal walls of the legs 28, 30 and with their threaded ends extending outwardly. The threaded end of each shoulder screw is threadedly connected to a respective cap 72, 74 which secures the ribs together against the legs 28, 30 on the respective bracket 20, 22 while permitting the disks to pivot on the shoulder portion of the screw relative to each other and the legs 28, 30. Preferably each central tang 46, 52 extends radially from its respective disk 58, 64 while the other tangs 44, 48, 50, 54 extend tangentially from their respective disk 56, 60, 62, 66 so that the ribs on each side of the sunshade assembly are aligned to form the ribs 32, 34, 36 into front, central and rear rib members respectively so as not to overlay or interfere with each other and permit independent movement. Thus, the ribs can be readily moved apart or together in accordion fashion. Although in the preferred form of the invention the disks and tangs are preferably steel, so as to have rigidity, they may also be formed from synthetic plastics such as nylon, while the caps 72, 74 preferably may be formed from synthetic plastic material and may have an internally threaded metallic insert 76 for receiving the ends of the screws.

Carried by the main or central portion of the tubular portion each rib 32, 34, 36 is a canopy 78 formed from a fabric or similar material having desirable aesthetics, the canopy being attached to the ribs by conventional means such as interlockable loop and hook material, e.g., VELCRO, or stitching, and may be formed with tubular sleeves at the front and rear thereof for receiving the front and rear ribs 32, 36 prior to assembly of the tubular portions 38, 42 of the ribs to the respective tangs 44, 50 and 48, 54 at the ends thereof, while the central rib 34 may merely have stitching or the like looped about the tubular portion 40 and the adjacent portion of the canopy.

The bottom leg members 24, 26 of each respective base bracket 20, 22 are interconnected together in adjustable fashion with one leg, e.g., 26, disposed on the other leg 24. To this end the leg member 24 includes a bore 80 while the leg member 26 has a transversely elongated slot 82. Connecting means such as a screw 84 and a nut or other threaded receptacle 86 extends through the bore 80 and through the slot 82 to secure the bracket legs 24, 26 together in superposed abutting relationship in a selectively adjusted disposition. Thus, the base portion 18 selectively may be expanded or contracted transversely to accommodate the widths of different infant or child car seats while the resiliency of the tubular rib members 38, 40, 42 permits such adjustability and provide sufficient flexibility for the ribs to expand or contract cooperatively. The leg member 24 preferably may include a pair of upstanding flanges 88 at front and rear edges thereof which straddle the leg member 26 to preclude it from pivoting about the connecting means 84, 86 so that the ribs do not twist.

Accordingly, the base may be expanded or retracted so that the sunshade assembly may be utilized with substantially all of the known car seats to protect the infant or child from the sun. When the car seat is initially positioned on the adjustable base of the shade assembly the ribs and the canopy may be pivoted rearwardly to fold the canopy out of the way and permit the child to enter the seat. It can then be pivoted forwardly and expanded to overlay the child in superposed relationship with the child. When it is desired to collapse the canopy, this may be readily accomplished by pivotable movement of the ribs to the desired position.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A sunshade assembly comprising a base having first and second members, each of said members having an elongated leg adapted to be disposed beneath a child car seat and an end portion extending upwardly from said leg member adapted to be disposed beyond the sides of said seat, a first of said legs being positioned upon the second of said legs and movable relatively thereto to change the spacing between the end portions, adjustable means for interconnecting said legs together at selective positions corresponding to desired spacings between said end portions, a plurality of substantially U-shape ribs, journal means for pivotably mounting the distal ends of each rib to a respective one of said end portions for permitting said ribs to pivot relative to said first and second members, and a canopy fastened to a central portion of each rib for providing a covering adapted to be superposed over a child car seat.

2. A sunshade assembly as recited in claim 1, wherein said adjustable means comprises a bore extending substantially normal through one of said legs, a slot elongated in the direction of elongation of the other of said legs and extending substantially normal through said other of said legs, and securing means extending through said bore and said slot for clamping said legs together at selective positions.

3. A sunshade assembly as recited in claim 2, including alignment means for precluding twisting of said first and second members transversely relatively to each other.

4. A sunshade assembly as recited in claim 1, wherein said journal means comprises a disk connected to each distal end of each rib, an axially extending bore formed through each disk, the disks at each respective end portion being sandwiched together with the corresponding axial bores in alignment, a journal pin carried by each end portion and disposed through the axial bores of the corresponding disks, and means connected to each journal pin for substantially precluding axial dislodgment of the associated disks.

5. A sunshade assembly as recited in claim 4, wherein each disk includes a tang extending from the periphery thereof, and each rib includes a tubular member having ends thereof for receiving and securely gripping a respective tang.

6. A sunshade assembly as recited in claim 5, wherein said adjustable means comprises a bore extending substantially normal through one of said legs, a slot elongated in the direction of elongated of the other of said legs and extending substantially normal through said other of said legs, and securing means extending through said bore and said slot for clamping said legs together at selective positions.

7. A sunshade assembly as recited in claim 6, including alignment means for precluding twisting of said first and second members transversely relatively to each other.

8. A sunshade assembly as recited in claim 1, wherein said first and second members each comprise a substantially L-shaped bracket forming the respective elongated leg and an upstanding leg defining the respective end portion, said adjustable means comprising a bore extending through one of the elongated legs substantially normal to said one leg, a slot elongated in the direction of elongation of the other of said elongated legs and extending substantially normal through the other of said elongated legs, and securing means extending through said bore and said slot for clamping said elongated legs together at selective positions.

9. A sunshade assembly as recited in claim 8, including alignment means for precluding twisting of said first and second members transversely relatively to each other.

10. A sunshade assembly as recited in claim 9, wherein said alignment means comprises upstanding elongated spaced apart walls disposed on the lower one of said elongated legs, said walls being spaced apart for receiving the upper one of said elongated legs therebetween while precluding twisting of said upper one of said elongated legs relative to said lower of said elongated legs.

11. A sunshade assembly as recited in claim 8, wherein said journal means comprises a disk connected to each distal end of each rib, an axially extending bore formed through each disk, the disks at each respective end portion being sandwiched together with the corresponding axial bores in alignment, a journal pin carried by each upstanding leg and disposed through the axial bores of the corresponding disks, and means connected to each journal pin for substantially precluding axial dislodgment of the associated disks.

12. A sunshade assembly as recited in claim 11, wherein each disk includes a tang extending from the periphery thereof, and each rib includes a tubular member having ends thereof for receiving and securely gripping a respective tang.

13. A sunshade assembly as recited in claim 12, including alignment means for precluding twisting of said first and second members transversely relatively to each other.

14. A sunshade assembly as recited in claim 13, wherein said alignment means comprises upstanding elongated spaced apart walls disposed on the lower one of said elongated legs, said walls being spaced apart for receiving the upper one of said elongated legs therebetween while precluding twisting of said upper one of said elongated legs relative to said lower of said elongated legs.

* * * * *